United States Patent [19]

Goldman

[11] 4,168,616

[45] Sep. 25, 1979

[54] LOCKING ARRANGEMENTS PARTICULARLY FOR SAFES

[76] Inventor: Ilan Goldman, 10, Bar Eli St., Tel Aviv, Israel

[21] Appl. No.: 827,238

[22] Filed: Aug. 24, 1977

[30] Foreign Application Priority Data

Feb. 16, 1977 [IL] Israel ..... 51464

[51] Int. Cl.[2] ..... E05B 63/14; E05B 37/00

[52] U.S. Cl. ..... 70/119; 70/133; 292/34; 292/37

[58] Field of Search ..... 70/114, 115, 116, 118, 70/119, 120, 126, 133; 292/34, 35, 37, 170

[56] References Cited

U.S. PATENT DOCUMENTS

| | | | |
|---|---|---|---|
| 183,192 | 10/1876 | Millward | 70/119 |
| 554,126 | 2/1896 | Hulse et al. | 70/119 |
| 1,670,277 | 5/1928 | Albach | 70/118 |
| 1,876,193 | 9/1932 | Wolters | 70/118 |
| 1,885,238 | 11/1932 | Diesel | 70/118 |
| 1,977,853 | 10/1934 | Kemp | 70/118 |
| 2,445,511 | 7/1948 | Claveria | 70/119 |
| 2,494,575 | 1/1950 | O'Brien | 70/119 |
| 2,766,608 | 10/1956 | Hirn | 70/119 X |
| 3,255,618 | 6/1966 | Hermann | 70/114 |
| 3,760,618 | 9/1973 | Wiczer | 292/37 X |

FOREIGN PATENT DOCUMENTS

| | | | |
|---|---|---|---|
| 1255 | of 1888 | United Kingdom | 70/118 |
| 297615 | 9/1928 | United Kingdom | 70/120 |

*Primary Examiner*—Thomas J. Holko

[57] ABSTRACT

A locking arrangement is described particularly for safe doors including a dial combination lock and a locking-bar mechanism having a plurality of locking bars movable from an extended locking position to a withdrawn unlocking position with respect to the door, the combination lock comprising a rotatably-mounted dial ring circumscribing the rotary dial and coupled to the locking bars to move them between their locking and unlocking positions, the combination lock including a lock-bolt effect when in its locking position to immobilize the locking bars and the dial ring at their locking positions.

10 Claims, 13 Drawing Figures

LOCKING ARRANGEMENTS PARTICULARLY FOR SAFES

BACKGROUND OF THE INVENTION

This invention relates to locking devices, particularly of the kind used in safes wherein there is provided a single or multi-bolt locking mechanism for operating locking bars or rods displaceable in the direction of the door frame of the safe, and adapted to project into suitable recesses provided therein.

Normally, such mechanisms—of which many and various types of construction are known—are operated from the outside of the door by a handle or a wheel, rotatable between a locked position, wherein the bolts are extended to project into the recesses, and an unlocked position wherein the bolts are withdrawn from said recesses.

There is further provided a separate, usually key-operated or combination lock, whose function is to prevent the unauthorized opening of the safe. This is achieved by installing the lock in such a manner that the locking thereof would interfere with the free movement of the said bars in the unlocking direction.

These conventional arrangements suffer from the disadvantage that the assembly of every door requires the mounting and installation of at least two separate, independent devices—the locking-bar mechanism and the combination (or other) lock; for each installation there must first be prepared, by drilling or otherwise, a special opening in the material of the door providing access thereto, and then each must be individually and properly mounted at the inner side of the door.

It is therefore the general object of the present invention to provide a locking arrangement readily operable vea only a single opening through the door.

It is a further object of the invention to save the extra installation costs involved in the separate handling and assembly of a locking-bar mechanism and of the combination lock.

It is a still further object of the invention to provide an arrangement or unit comprised of a combination of a single or multiple locking-bar mechanism and a combination lock.

It is a still further object of the invention to incorporate an anti-explosion safety device in said combined unit.

SUMMARY OF THE INVENTION

According to the invention, there is provided a locking arrangement particularly for safe doors including a locking-bar mechanism and a dial combination lock. The locking-bar mechanism comprises at least one locking bar movable from an extended, locking position to a withdrawn, unlocking position with respect to the door. The combination lock comprises a rotary dial, a dial-ring circumscribing the rotary dial, and a lock-bolt movable from an extended, locking position to a withdrawn, unlocking position. The dial-ring is rotatably mounted around the rotary dial and is coupled to the locking bar to move same between its locking and unlocking positions. The lock-bolt of the combination lock is effective, in the locking position of the combination lock, to immobilize the locking bar and the dial ring at their locking positions, thus preventing the forced unlocking of the door.

The number of locking bars may be one, extending in axial alignment with the lock-bolt or preferably, a larger number including, two extending perpendicularly to the axial direction of the lock-bolt.

The rotational movement of the dial-ring may be converted into linear movement of the locking bar via a slidable plate coupled between the dial ring and the locking bars. Alternatively, a rotatable disc may be provided coupled through rotational transmission means such as a linkage or gear train, to the dial-ring.

According to another aspect of the invention, the said arrangement could be provided with an anti-explosion safety device, adapted to cooperate with said locking-bar mechanism to lock same when subjected to the blast of an explosion.

BRIEF DESCRIPTION OF THE DRAWINGS

These and further features and advantages of the invention will be more fully understood from the ensuing description thereof, given by way of example only, with reference to the attached drawings, wherein—

DETAILED DESCRIPTION OF THE PREFERRED EMBODIMENTS

Figure 2:
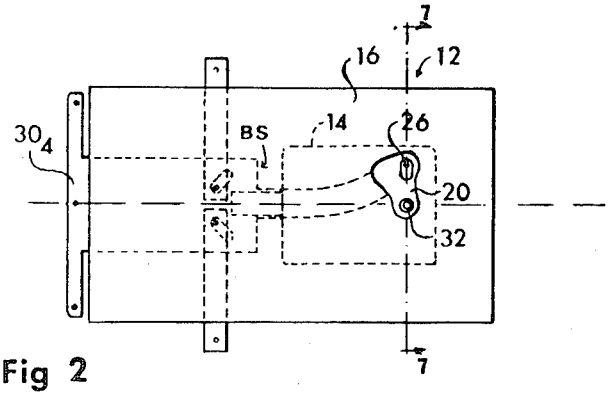
FIG. 2 is a plan view taken along the line 2—2 of FIG. 1.
Figure 1:
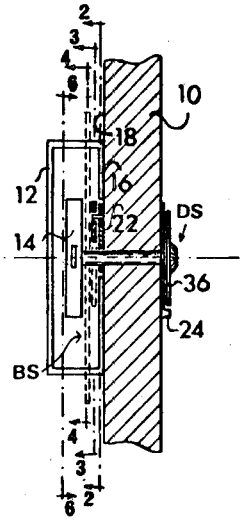
FIG. 1 is a general side view of the assembled arrangement according to the invention.

In FIG. 1 the numeral 10 designates a portion of an armoured door of a safe, or other strongbox. At the outside of the door there is provided the dial device, generally indicated DS, and at the inside—the housing 12 accommodating the combination lock 14 and the locking bar mechanism BS.

The construction of the arrangement confined within the housing 12 will now be described with reference to the series of successive sectional views marked 2—2 through 6—6 shown in FIGS. 2 to 6, respectively.

Figure 3:
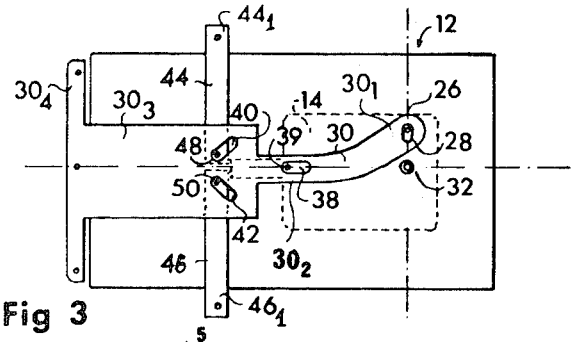
FIG. 3 is a plan view taken along the line 3—3 of FIG. 1.

Rear wall 16 of the housing 12 is in contact with the inner wall 18 of the door 10. There is formed in the wall 16 an opening 20, adapted to accommodate a cam, arm, or similar driving member 22 rigidly fastened to the dial-ring 24 of the combination lock 14 (see FIG. 7). In the illustrated embodiment the driving member is constituted by an eccentrically mounted pin 26 slidably engageable within a slot 28 formed at the rear end portion $30_1$ of a plate 30 (FIG. 3).

Figure 7:
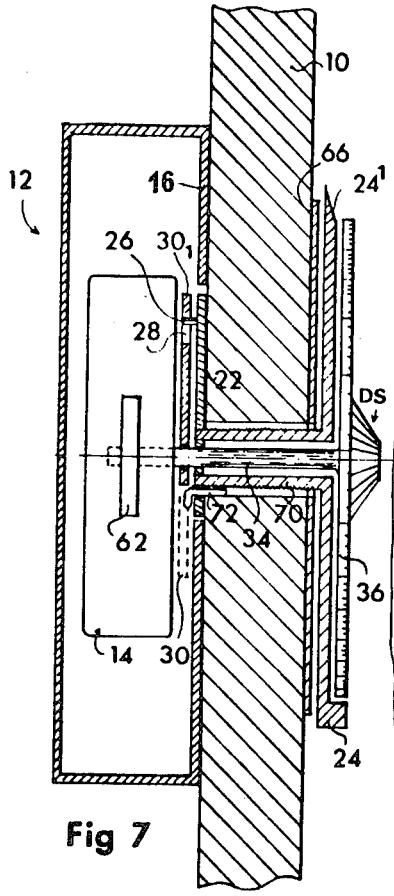
FIG. 7 is a section along line 7—7 of FIG. 2 on an enlarged scale.

The plate 30 end or tail portion $30_1$ is offset with respect to the opening 32 of the combination lock 14, to accommodate the stem 34 of the dial 36 (FIG. 7). Plate 30 further includes a narrow guide portion $30_2$ provided with a slot 38, for guiding the plate along a pin 39 fixed to the rear housing wall 16, a widened main portion $30_3$ having a pair of oblique slots 40 and 42 provided for the guided slide movement of the upper and lower locking bars and a front portion $30_4$ forming an attachment piece for the side locking bars. The drawings illustrate only the attached portions of the locking bars, namely attachment bars 44 and 46 of the upper and lower locking bars, and attachment portion $30_4$ for two side locking bars.

Figure 5:
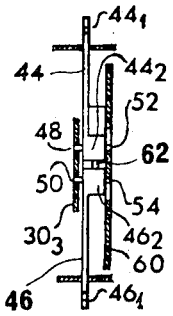
FIG. 5 is a plan view taken along the line 5—5 of FIG. 4.
Figure 6:
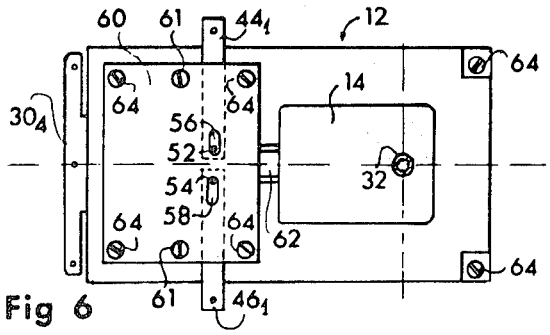
FIG. 6 is a plan view taken along the line 6—6 of FIG. 1.

At a plan still further remote from the wall 16 of the housing 12 can be seen the two normally vertically aligned attachment portions 44, 46 of the upper and lower locking bars. Each such attachment portion is provided with an outwardly projecting portion $44_1$, $46_1$ to be attached to its respective bar or rod (not shown), and an inner widened portion $44_2$, $46_2$ (FIG. 5). These portions $44_2$, $46_2$ are each provided with a first pin 48, 50 slidably guided in the slots 40 and 42, respectively, and a second pin 52, 54 similarly provided within slots 56, 58 formed in a cover plate 60 (FIG. 6). The cover plate 60 is fixed by screws 61 to the rear wall 16 of the housing 12, thereby enclosing and holding-together the bolt driving mechanism. Moreover, the plate 60 provides a support for an anti-explosion safety device which may conveniently be installed according to the invention in the manner described below in connection with FIGS. 9 and 10.

The combination lock housing 14 (FIG. 4) is located within the housing 12 (above the tail portion $30_1$ of the plate 30) so that the bolt or tongue 62 thereof would be placed immediately behind the portions $44_2$ and $46_2$ of the attachments 44 and 46, preferably in symmetrical relationship with respect thereto.

The housing may be fastened, as by screws 64, (FIG. 6) to the inside of the door 10 at the proper location and as an independent, self-contained unit.

Figure 8:
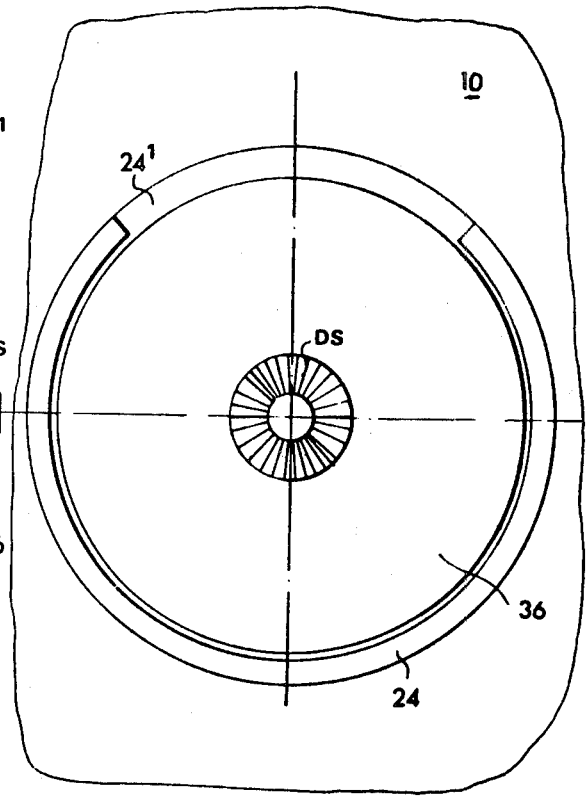
FIG. 8 is a side view of the arrangement of FIG. 7.

Before proceeding with the mounting of the housing 12, the dial system DS would be assembled in the manner illustrated in FIGS. 7 and 8. As shown, the dial proper consists of the rotatable disc 36 bearing around its circumference the numbers scale used for the presetting of the combination, with reference to a certain fixed mark. Normally, such mark would appear on the dial ring, since in the conventional combination locks the ring is fixed to the door; in the case of the present invention, however, the ring is adapted to rotate about the dial disc, but it is limited to certain predetermined extreme positions corresponding to the extended and withdrawn positions of the driving mechanism for the locking bars as above described. Therefore, the "fixed" reference mark may still be provided on the dial-ring 24, bearing in mind that it would be used only when the ring is placed in its locking position, wherein the dial must be first manipulated to open the combination lock and thus release the locking bars.

Alternatively, a proper fixed mark may be provided on the door 10 or on an auxiliary ring 66 fixedly mounted on the door 10, behind the dial-ring 24.

The rotatable dial disc 36 has a stem 34 centrally extending therefrom and coupled to the combination lock 14. The rotatable dial-ring 24 is provided with a sleeve member 70 forming a fixed support for the cam or arm member 22. The arm member is fixedly held by the sleeve 70, such as through a screw-thread adjustable connection, locked at the proper position by a wedge or key 72; at such a position, the pin 26 would be located within the slot 28 of the plate 30 (see FIG. 2). The sleeve 70 may be supplied at various lengths to fit the width of the respective door 10, or provided at a greater length and cut by installer to the proper length.

As shown in FIG. 8, ring 24 is formed with an outer circumferential flange part of which is removed to provide an opening or recess $24_1$ exposing the relevant portion (s) of the numbers scale, provided on the circumferencial face of the rotary dial 36 while the rest of the numbers scale remains concealed for safety purposes, as known in the art.

The operation of the arrangement will now be briefly described. Let us assume that both the constituent subassemblies—namely the locking-bars mechanism and the combination lock—are in the open, unlocked positions; hence, the plate 30 would be at the extreme right-hand side (cf. FIG. 3), and the bolt 62 of the lock 14 fully withdrawn (FIG. 4).

It would be impossible at this stage to operate (lock) the combination lock 14, since the displacement of the bolt 62 would be blocked by the portions $44_2$, and $46_2$ of the bolt-bars attachment pieces 44 and 46.

First then, one must manipulate the plate 30 by rotating the dial-ring 24 counter-clockwise (with respect to FIG. 8). This rotation of ring 24 (which may be conveniently done by gripping the outer face of its flange) causes arm 22, keyed to sleeve 70 of the dial-ring 24, to rotate pin 26 carried by arm 22. The latter pin, being received within slot 28 of plate 30, moves plate 30 leftwardly (FIG. 3) to the broken-line position illustrated in FIG. 4. This results in the sliding of the pins 48 and 50 along the oblique slots 40 and 42, displacing the bar 44 upwards and the bolt 46 downwards. The safe door would thus be locked but not yet safeguarded against unlocking by just operating the dial-ring 24 in the opposite direction.

Figure 4:
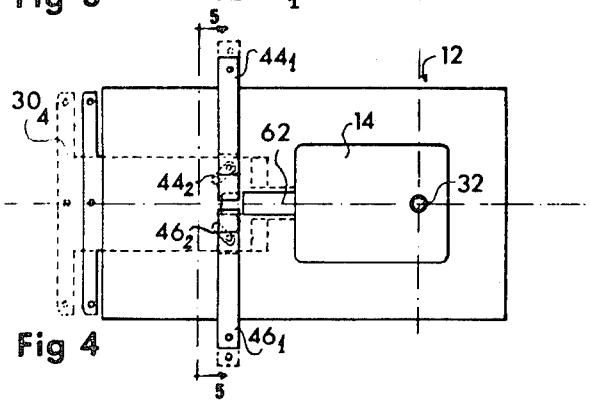
FIG. 4 is a plan view taken along the line 4—4 of FIG. 1.

The complete locking is effected by the operation of the combination lock 14, whose bolt 62 becomes placed in the no-longer occupied space behind and between the portions $44_2$ and $46_2$ of the locking-bar attachments 44 and 46, as shown in dashed lines in FIG. 4.

Obviously, the reverse routine would be applied for the unlocking of the safe.

Figure 9:
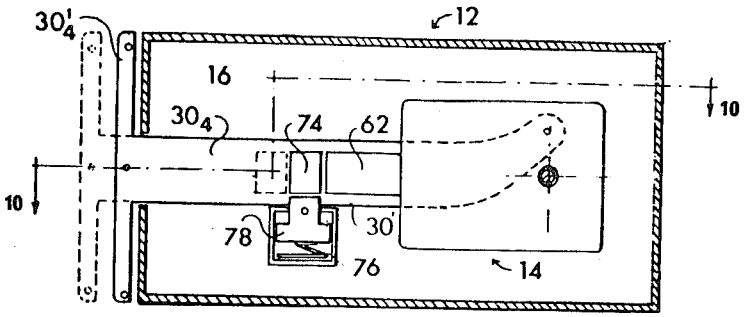
FIG. 9 is a plan view of a second embodiment of the invention employing a single door-bolt.

It would now be readily appreciated by those skilled in the art to which this invention pertains that the basic principles thereof may be applied in many and various manners. For example, as illustrated in FIGS. 9 and 10, the arrangements according to the invention may include only a single locking-bar attachment $30_4'$, forming a part of the slidable plate 30' (similar to the plate 30 of the former embodiment), cooperating with the combination lock 14.

The plate 30' is provided with a projecting block 74 located, at the unlocked positions of the arrangement, next to and in front of the tongue 62.

Figure 10:
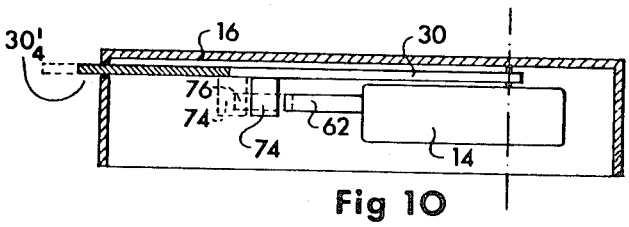
FIG. 10 is a view, partly in cross-section, taken along line 10—10 of FIG. 9.

When the plate 30' is operated into the locked position, shown in dashed lines in FIG. 10, a gap would be formed between the tongue 62 and the block 74; locking of the combination lock 14 would result in the reclosing to the said gap by the tongue 62 following-suit behind the block 74 to immobilize the plate 30' as well as the dial-ring coupled thereto, as above described with respect to the former embodiment.

In an analogous way, another single-bolt configuration may be attained by simply omitting one of the locking-bar attachments 44 or 46 of FIGS. 1 to 6.

It has already been mentioned that, optionally, the invention offers a convenient and effective way of providing an anti-explosion safety device. Various such devices are known, operating on the basis of a spring-loaded, latch member which is normally neutralized but adapted to lock the bolt system automatically upon the occurrence of a major damage to the lock or lock-housing by the blast of explosives.

Figure 11:
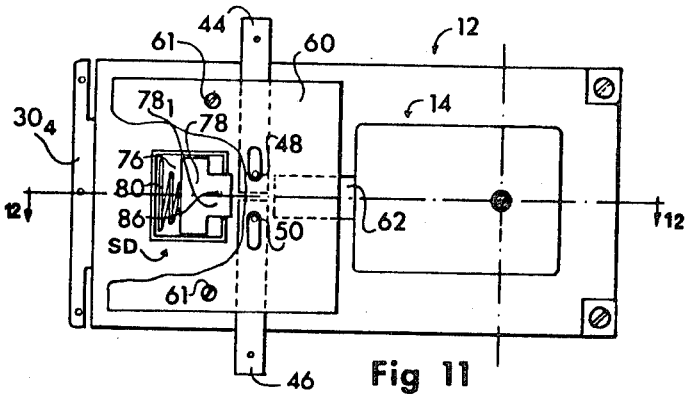
FIG. 11 is a plan view of the arrangement of FIGS. 1-6 including an anti-explosion safety device.
Figure 12:
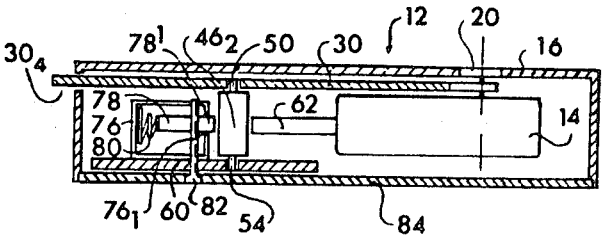
FIG. 12 is a section along line 12—12 of FIG. 11.

In FIGS. 11 and 12 the same reference numerals have been used for parts and components that appeared already in FIGS. 1 to 6.

The safety device generally indicated SD has a housing 76 fixedly attached to the underside of the plate 60. Within the housing 76 there is provided a latch-member 78 having a tongue portion $78_1$ adapted to extend through a suitable opening $76_1$ formed in the side-wall of the housing 76.

The member 78 is constantly biased, in the direction of the opening $76_1$, by a spring 80, but kept in its retracted position by a pin 82. The pin 82 is fixed to a cover plate 84 of the housing 12, and extends through the plate 60 into the housing 76 and into a bore 86 formed in the portion $78_1$.

It will be clear that, should the cover 84 be sprung away as by an explosion or other attempted burglary, the latch 78 would become released from the pin 82 and shot into the gap between the locking-bars 44 and 46, vis-a-vis the bolt 62, to replace the same by the portion $78_1$ in case the lock 14 is also removed or dislocated as a result of the blast.

Referring back to FIG. 9 of the single bolt embodiment, the provision of the anti-explosion device 76 is illustrated, acting, however, in a direction normal to the axial direction of the lock-bolt 62. The operation of the device would be analogous to that described in the multi-bolt embodiment and therefore need not be further explained.

Figure 13:
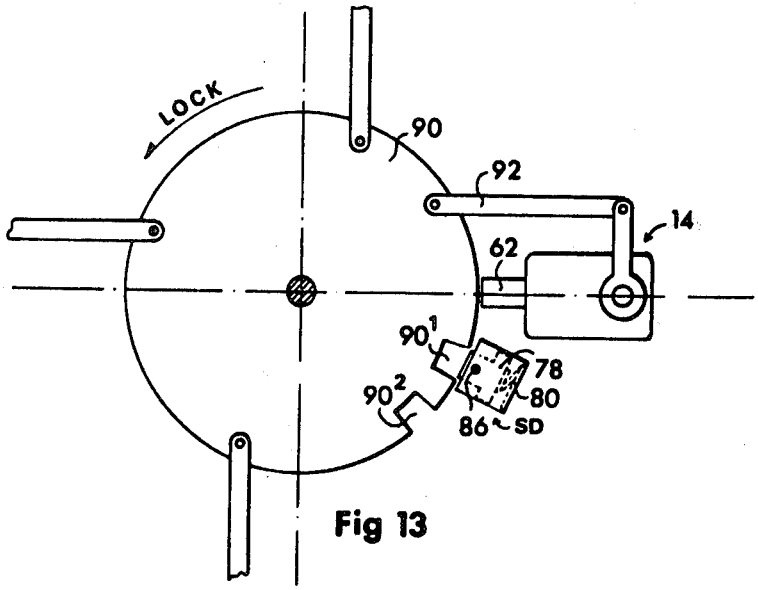
FIG. 13 is a schematic representation of another embodiment of the invention.

According to another modified embodiment of the invention, schematically shown in FIG. 13, the linear slidable plate 30 according to the previous embodiment may be substituted by a rotatable bolt-bars driving member such as a disc 90, coupled through any suitable transmission means such as a linkage bar (or bar system) 92 to the dial-ring (not shown).

The safeguarding interaction between the combination lock 14 may be attained through the provision of a recess $90_1$ suitably located with respect to the bolt 62 of such lock, so that in the locking position of the door, the bolt 62 would project and fit into the recess or cutout $90_1$ to prevent any attempted forced or otherwise unauthorized opening thereof.

If required, an anti-blast device SD may be provided in a similar manner. For this purpose, a second cut-out $90_2$ would be formed as shown, the relative location of the cut-outs $90_1$, and $90_2$, the bolt 62 and the device SD being such that in the locked position of the disc 90, the bolt 62 would project into the cut-out $90_1$ while the cut-out $90_2$ would be exactly in front of the latch 78. Should an explosion occur, the released latch 78 would snap into the cut-out $90_2$, and immobilize the disc 90 irrespective of the presence of the bolt 62.

It has thus been established that the arrangement according to the present invention provides many advantages over those known in the art, especially when, as described, door-bolt attachments are employed confined in a housing to form a compact, readily mountable self-contained unit by a single assembly operation. The versatility of the unit is further extended noting that adequate space is provided in the housing so that various types and sizes of combination locks may be installed as requested for any specific installation.

Other variations and modifications may be applied to the invention and hereinbefore described and defined in the appended claims.

What is claimed is:

1. A locking arrangement particularly for safe doors including a locking-bar mechanism and a dial combination lock, said locking-bar mechanism comprising at least one locking-bar movable from an extended, locking position to a withdrawn, unlocking position with respect to said door, said combination lock comprising a rotary dial, a dial-ring circumscribing said rotary dial, and a lock-bolt, movable from an extended locking position to a withdrawn, unlocking position, characterized in that said dial-ring is rotatably mounted about said rotary dial and is coupled to said locking-bar to move same between its locking and unlocking positions, said lock-bolt being adapted in the locking position of the combination lock, to immobilize said locking bar and said dial-ring at the locking positions thereof, thus preventing the forced unlocking of the door.

2. The arrangement as claimed in claim 1, wherein said dial-ring is formed with an outer circumferential flange grippable by the user to rotate same and thereby to move the locking bar, the upper portion of said flange being removed to enable viewing numbers carried on the circumferential face of the rotary dial.

3. The arrangement as claimed in claim 1 wherein said locking bar is coupled to said dial-ring via a slidable plate and cam means for converting the said rotatable movement of the dial-ring into a linear movement of said locking bar.

4. The arrangement as claimed in claim 1 wherein there are a pair of axially aligned locking bars extending perpendicularly to the said lock-bolt and having inner ends spaced from each other in the locking position of the bars, the lock-bolt being adapted in said locking position thereof to be disposed in the space between said inner ends thereby preventing the forced withdrawal of the locking bars.

5. The arrangement as claimed in claim 4 wherein said locking bars are coupled to said dial-ring via a slidable plate provided with first cam means for converting the said rotatable movement of the dial-ring into a linear sliding movement of the plate and second cam means for converting the linear movement of the plate into a linear sliding movement of said locking bars.

6. The arrangement as claimed in claim 5 wherein said first cam means include a pin carried by the dial-ring and adapted to slide within guide-slots formed in said plate.

7. The arrangement as claimed in claim 5 wherein said second cam means includes a pin carried by said locking bars each adapted to slide within a guide-slot provided in said plate.

8. The arrangement as claimed in claim 1 comprising a rotatably mounted disc to which said locking bar is pivotably connected, said dial-ring being coupled to said disc through rotational movement transmission means, a cut-out being provided in the disc into which said lock-bolt is adapted to project in the locked positions of the locking bar and the lock-bolt.

9. The arrangement as claimed in claim 1, including an anti-explosion safety device comprising a spring-loaded latch member adapted, when the device is actuated, to project into a space normally occupied by said lock-bolt.

10. The arrangement as claimed in claim 8 including an anti-explosion safety device comprising a spring-loaded latch member adapted, when the device is actuated, to project into a second cut-out provided in said disc.

* * * * *